US009102445B2

(12) United States Patent
Merchant

(10) Patent No.: US 9,102,445 B2
(45) Date of Patent: Aug. 11, 2015

(54) TANK ASSEMBLY HAVING TWIST-AND-LOCK MOUNTING FLANGE

(75) Inventor: Jack A. Merchant, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 679 days.

(21) Appl. No.: 13/095,618

(22) Filed: Apr. 27, 2011

(65) Prior Publication Data

US 2012/0273502 A1 Nov. 1, 2012

(51) Int. Cl.
*B65D 41/06* (2006.01)
*B65D 43/02* (2006.01)

(52) U.S. Cl.
CPC ..... *B65D 43/0229* (2013.01); *Y10T 29/49826* (2015.01)

(58) Field of Classification Search
USPC ..... 220/295, 297, 301, 787, 293; 285/209
See application file for complete search history.

(56) References Cited

U.S. PATENT DOCUMENTS

| | | | | |
|---|---|---|---|---|
| 3,918,605 | A * | 11/1975 | Butler | 220/495.06 |
| 4,146,147 | A * | 3/1979 | Sloan, Jr. | 220/203.26 |
| 5,301,985 | A | 4/1994 | Terzini | |
| 5,333,915 | A | 8/1994 | Sparling et al. | |
| 5,622,392 | A * | 4/1997 | Gochenouer | 285/124.1 |
| 5,972,398 | A | 10/1999 | Ludwig et al. | |
| 5,979,910 | A | 11/1999 | Shinohara et al. | |
| 6,102,444 | A | 8/2000 | Kozey | |
| 6,102,450 | A | 8/2000 | Harcourt | |
| 6,481,763 | B2 | 11/2002 | Mintz et al. | |
| 6,708,730 | B2 * | 3/2004 | Chikuma et al. | 138/155 |
| 6,733,045 | B2 | 5/2004 | Harrington et al. | |
| 7,017,953 | B2 | 3/2006 | Benscoter et al. | |
| 7,069,643 | B2 * | 7/2006 | Shevela et al. | 29/758 |
| 7,341,047 | B2 * | 3/2008 | Sone et al. | 123/509 |
| 7,344,042 | B2 * | 3/2008 | Hagano | 220/288 |
| 2003/0094763 | A1 * | 5/2003 | Benjey | 277/314 |
| 2005/0194796 | A1 * | 9/2005 | Powell | 292/256 |
| 2006/0260129 | A1 * | 11/2006 | Bergsma et al. | 29/890.124 |
| 2009/0184122 | A1 * | 7/2009 | Suga | 220/298 |
| 2010/0162690 | A1 | 7/2010 | Hosaka et al. | |

FOREIGN PATENT DOCUMENTS

| | | |
|---|---|---|
| FR | 2915185 | 10/2008 |

* cited by examiner

*Primary Examiner* — Jeffrey Allen
(74) *Attorney, Agent, or Firm* — Finnegan, Henderson, Farabow, Garrett & Dunner, LLP

(57) ABSTRACT

A tank assembly is provided for a machine. The tank assembly may have a tank with a plurality of sides connected to each other to substantially enclose a volume. A first side of the plurality of sides has an upper surface and a lower surface, and defines an opening into the volume and a first rotational stop feature at the opening. The tank assembly may also have a mounting flange with an upper member configured to engage the upper surface of the first side, a lower member configured to engage the lower surface of the first side, and a second rotational stop feature. The tank assembly may additionally have a resilient member disposed between the tank and the mounting flange. The resilient member may be configured to substantially seal an interface between the tank and the mounting flange and to bias the second rotational stop feature toward the first rotational stop feature.

9 Claims, 4 Drawing Sheets

TANK ASSEMBLY HAVING TWIST-AND-LOCK MOUNTING FLANGE

TECHNICAL FIELD

The present disclosure relates generally to a tank assembly and, more particularly, to a fluid tank assembly having a twist-and-lock mounting flange.

BACKGROUND

Machines such as track-type tractors, wheel loaders, on- and off-highway haul trucks, motor graders, drill rigs, stationary pumps, and other heavy equipment often use different fluid systems to accomplish specialized tasks. For example, these machines may be equipped with a fuel system that powers an onboard engine, a cooling system that cools the engine, a lubrication system that lubricates different machine components, a hydraulic system that moves a work tool, a dosing system that injects reductant into an exhaust flow to reduce emissions, and/or other fluid systems known in the art. Each of these fluid systems requires a supply of an appropriate fluid in a sealed container, which maintains the supply in relative isolation from the environment and other fluids and contaminates of the machine. In addition, the container may need to provide a mounting platform for different components associated with each fluid system, for example filters, manifolds, pumps, sensors, valves, etc.

One example of a tank assembly that contains a fluid and provides a mounting platform for related system components is described in U.S. Patent Publication No. 2010/0162690 of Hosaka et al. that was published on Jul. 1, 2010 (the '690 publication). In particular, the '690 publication discloses an urea tank providing a mounting platform for a control valve. The tank is provided with a detachable closure member having a body formed to support the control valve, and an SAE standard locking ring connected to the body. The locking ring has an annular groove recessed into the ring adjacent a perimeter of the ring, and an o-ring gasket is positioned within the groove. When the closure member is connected to the tank, the o-ring gasket is compressed to form a seal between the tank and the closure member. Protruding channels defining arcuate segments are mounted at spaced locations to an upper surface of the tank. A plurality of supports, each carrying a radially outwardly extending flange, are coupled to an upper surface of the ring. When the closure member is locked in place, the flanges are positioned within the channels of the tank. As the ring is rotated to connect the closure member to the tank, the o-ring gasket is compressed by an increasing amount to assist in applying a biasing force that holds the ring and closure member stationary relative to the tank.

Although the closure member configuration of the '690 publication may be suitable for some applications, it may be less than optimal. In particular, the configuration may require complex tank and ring geometry that is expensive to fabricate and decreases durability. Further, because the only mechanism retaining the closure member rotationally fixed is the bias from the o-ring gasket, it may be possible for the ring to rotate away from the channels and the closure member and disassemble from the tank when exposed to excessive vibration. Finally, because the closure member provides specialized mounting capability for only the control valve, it may lack broad applicability.

The disclosed tank assembly is directed to overcoming one or more of the problems set forth above and/or other problems of the prior art.

SUMMARY

In one aspect, the present disclosure is directed to a tank assembly. The tank assembly may include a tank with a plurality of sides connected to each other to substantially enclose a volume. A first side of the plurality of sides may have an upper surface and a lower surface and defines an opening into the volume and a first rotational stop feature at the opening. The tank assembly may also include a mounting flange with an upper member configured to engage the upper surface of the first side, a lower member configured to engage the lower surface of the first side, and a second rotational stop feature configured to engage the first rotational stop feature. The tank assembly may additionally include a resilient member disposed between the tank and the mounting flange. The resilient member may be configured to substantially seal an interface between the tank and the mounting flange and to bias the second rotational stop feature toward the first rotational stop feature.

In another aspect, the present disclosure is directed to a fluid tank for a tank assembly. The fluid tank may include a plurality of sides connected to each other to substantially enclose a volume, and an opening through a first side of the plurality of sides. The opening may have a generally circular center and first and second arcuate recesses located at opposing sides of the circular center. The fluid tank may also include at least one rotational stop feature located at a periphery of the opening.

In yet another aspect, the present disclosure is directed to a mounting flange for a tank assembly. The mounting flange may include a first cylindrical member having an exterior axial surface with at least one attachment feature and an interior generally planar axial surface. The mounting flange may also include a second cylindrical member extending axially from the interior generally planar axial surface of the first cylindrical member, and at least one arcuate cam segment extending radially outward from a periphery of the second cylindrical member. The mounting flange may additionally include a rotational stop feature associated with the at least one arcuate cam segment.

In a final aspect, the present disclosure is directed to a method of connecting a component to a tank. The method may include placing a resilient member between a tank and a mounting flange, and passing a member of the mounting flange through an opening in a side of the tank. The method may further include compressing the resilient member between the tank and the mounting flange, rotating the mounting flange relative to the tank until a first rotational stop feature of the tank aligns with a second stop feature of the mounting flange, and allowing the resilient member to at least partially decompress and bias the first stop feature into engagement with the second stop feature.

DETAILED DESCRIPTION

Figure 1:
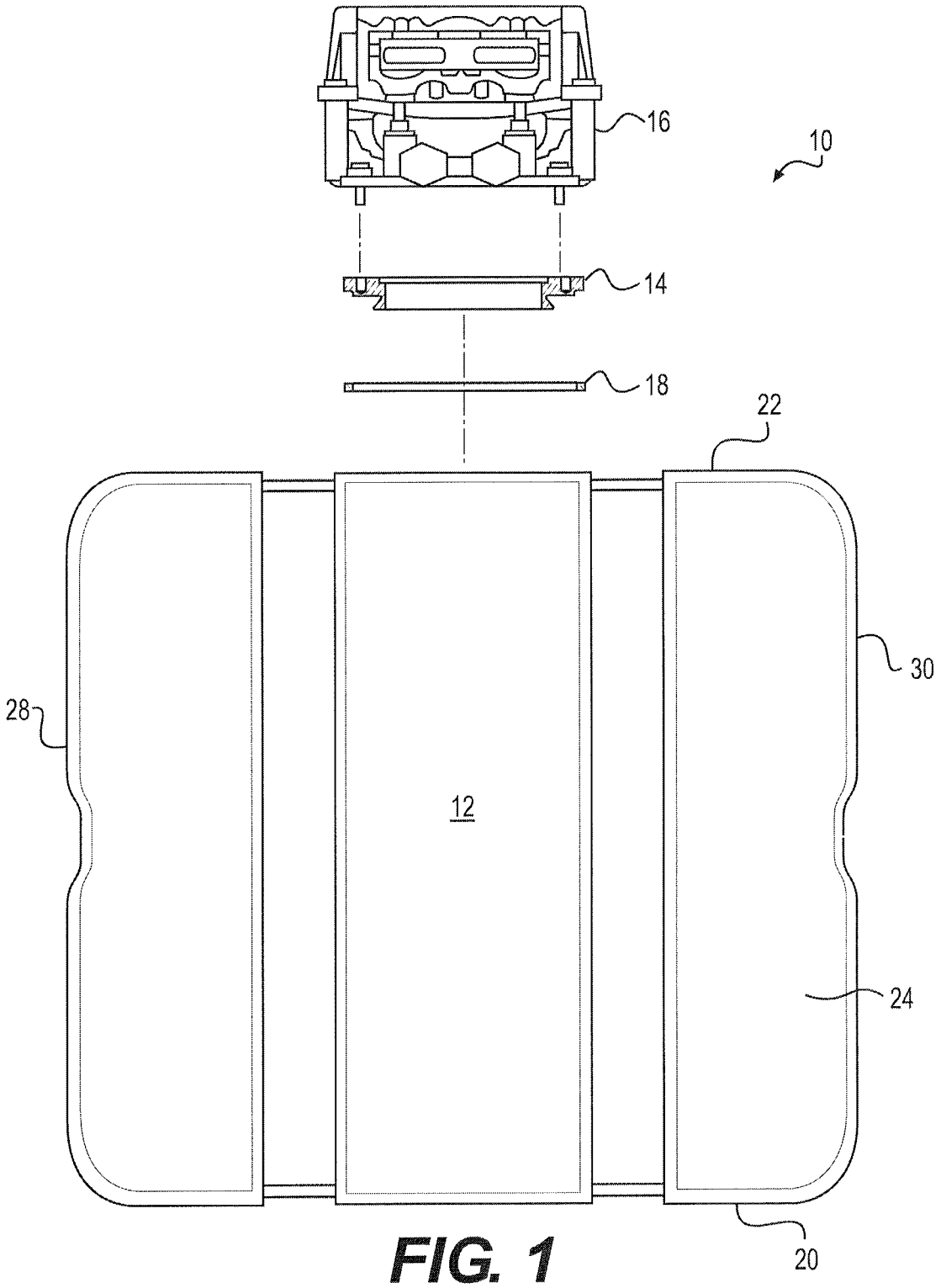
FIG. 1 is an exploded-view, partial cross-sectional illustration of an exemplary disclosed tank assembly.

FIG. 1 illustrates a tank assembly 10 configured to contain a liquid or gaseous fluid. In the disclosed embodiment, tank assembly 10 is intended for use with a reductant dosing system (not shown) and, accordingly, is configured to hold a reductant such as urea or a mixture of urea solids and water. It is contemplated, however, that tank assembly 10 may alternatively be used to hold another liquid or gaseous fluid, if desired, such as coolant, fuel, hydraulic oil, or lubricant. Tank assembly 10 may include, among other things, a tank 12, a mounting flange 14 that may be used to connect a system component 16 to tank 12, and a resilient member 18 located between tank 12 and mounting flange 14.

Figure 2:
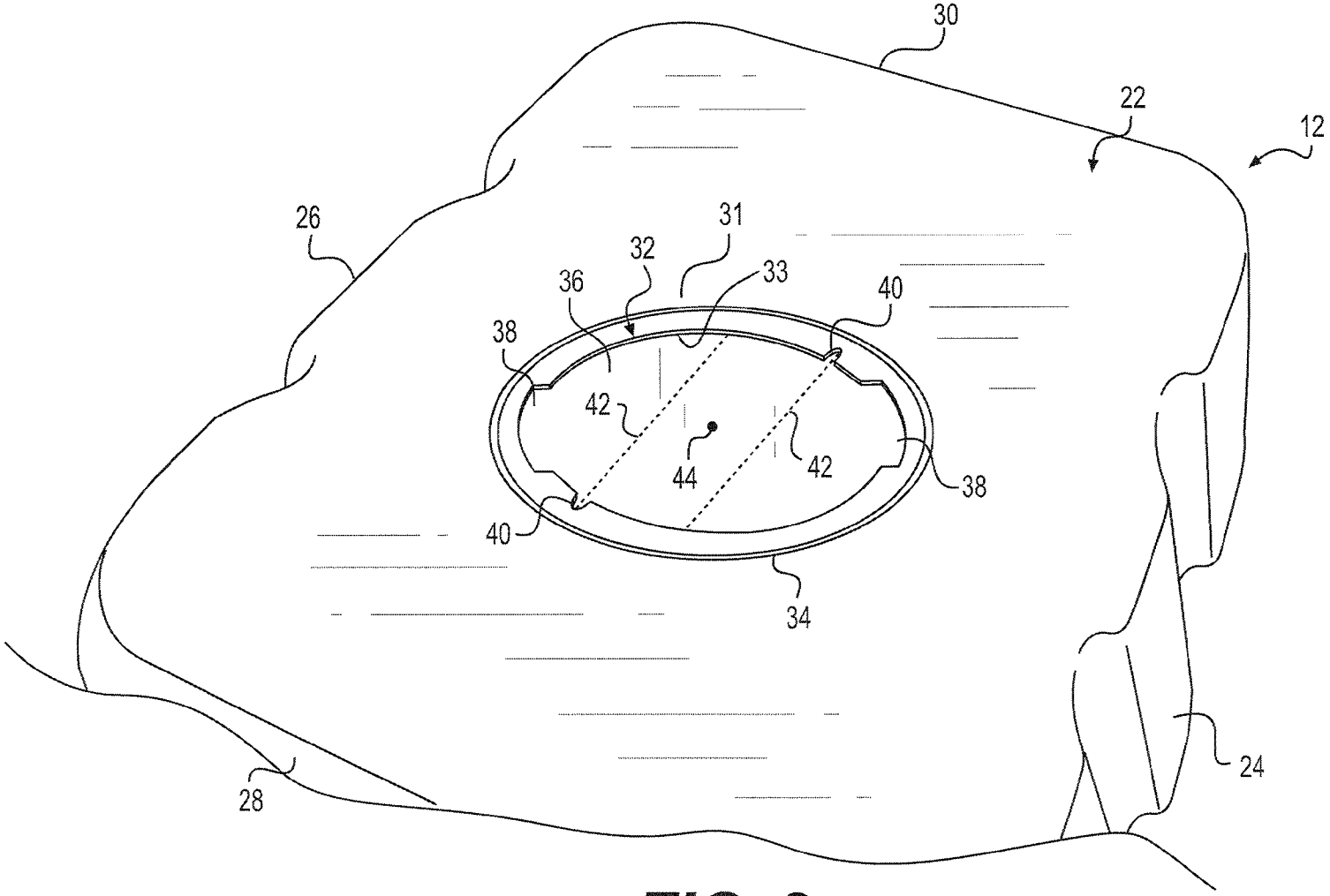
FIG. 2 is a pictorial illustration of an exemplary disclosed tank that may be used with the tank assembly of FIG. 1.

Tank 12 may include a plurality of sides connected to each other to substantially enclose a volume. For example, tank 12 may include a bottom side 20 (shown only in FIG. 1) configured to rest on a ground surface (not shown) and support a remainder of tank assembly 10, a top side 22 located opposite bottom side 20, a front side 24 connected between bottom and top sides 20, 22, a back side 26 (shown only in FIG. 2), a left side 28 located between front and back sides 24, 26, and a right side 30 located opposite left side 28. Although the sides of tank 12 are shown in FIGS. 1 and 2 as connected to each other to form a generally cubic three-dimensional structure, it is contemplated that tank 12 may alternatively form another desired shape, for example spherical, cylindrical, pyramidal, or another shape known in the art. Sides 20-30 may be connected together through any manner known in the art, for example through mechanical bonding (e.g., brazing, welding, etc.), chemical bonding (e.g., via adhesives), or mechanical fastening (e.g., riveting, threaded fasteners, etc.). Alternatively, sides 20-30 may be integrally formed into the cubic structure of tank 12 through a deep draw or molding process, if desired. Tank 12 may be fabricated from any material suitable to a particular application, for example plastic, aluminum, or stainless steel.

As shown in FIG. 2, top side 22 may include geometry configured to connect tank 12 to mounting flange 14 (referring to FIG. 1) and to provide access for system component 16 into the enclosed volume of tank 12. Specifically, top side 22 of tank 12 may include an upper or outer surface 31, a lower or inner surface 33, an opening 32 that extends from upper surface 31 through inner surface 33, and a groove 34 located within upper surface 31 radially outward of opening 32. Although shown as generally located within a lengthwise and widthwise center of top side 22, it is contemplated that opening 32 and groove 34 may be located at any appropriate position within top side 22, for example toward one edge of tank 12 or within a corner of top side 22, as desired.

Opening 32 may include a circular center 36 and at least one arcuate recess 38 located at a periphery of circular center 36. In the embodiment of FIG. 2, two substantially identical arcuate recesses 38 are shown as being located at opposing sides of circular center 36, although any number of arcuate recesses 38 may be included. Each of arcuate recesses 38 may be concentric with and have an outer diameter greater than an outer diameter of circular center 36, and an arc angle that is equal to or less than about 90°. The difference in diameters between circular center 36 and arcuate recesses 38 may vary based on application, and be related to a material composition of tank 12, a thickness of top side 22, and a retention force required for mounting flange 14 (referring to FIG. 1). The arc angle of recesses 38 may be constrained to be equal to or less than 90°, such that sufficient material between pairs of recesses 38 may be retained to support mounting flange 14.

One or more rotational stop features 40 may be provided within top side 22 at opening 32. In the disclosed embodiment, rotational stop features 40 are integral with opening 32, although it is contemplated that rotational stop features 40 may alternatively be completely separate from opening 32, if desired. As shown in FIG. 2, rotational stop features 40 may be radially-oriented recesses that extend outward from a periphery of circular center 36. Each of rotational stop features 40 may be elongated and have a length direction greater than a width direction, and a plane of symmetry (not shown) that is generally orthogonal to top side 22 and extends in the length direction along a dashed line 42. In the disclosed embodiment, the planes of symmetry of rotational stop features 40 may be generally parallel to each other, and tangential relative to an axis 44 of circular center 36 (i.e., not passing through axis 44). Rotational stop features 40 may be located in a clockwise direction from an arc end of the furthest arcuate recess 38 by about 90°. As will be described in more detail below, this geometry of rotational stop features 40 may facilitate reduced complexity and cost associated with manufacturing mounting flange 14 (referring to FIG. 1), while providing for a ¼ turn locking engagement between tank 12 and mounting flange 14.

Groove 34 may be located within upper surface 31 of top side 22 and configured to receive resilient member 18 (referring to FIG. 1). Groove 34 may have a generally square cross-section (shown in FIG. 6), a generally semi-circular cross-section (not shown), or any other cross-section known in the art. A depth of groove 34 may be less than a thickness (e.g., a diameter) of resilient member 18 such that, when mounting flange 14 is pressed against upper surface 31 of top side 22, resilient member 18 may be compressed by some amount. It is contemplated that groove 34 may alternatively be located within mounting flange 14 or partially within both tank 12 and mounting flange 14, if desired.

Figure 3:
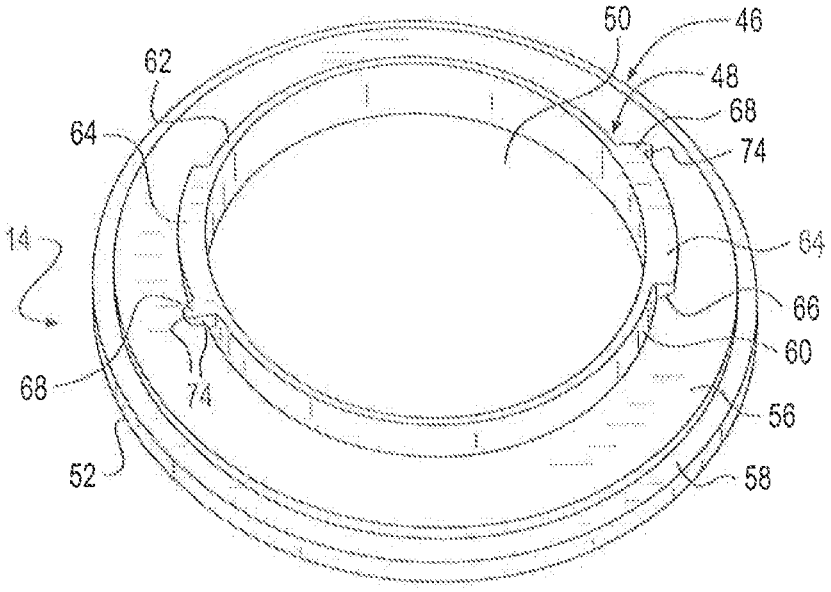
FIGS. 3-5 are pictorial, plan, and cross-sectional illustrations, respectively, of an exemplary disclosed mounting flange that may be used with the tank assembly of FIG. 1.
Figure 4:
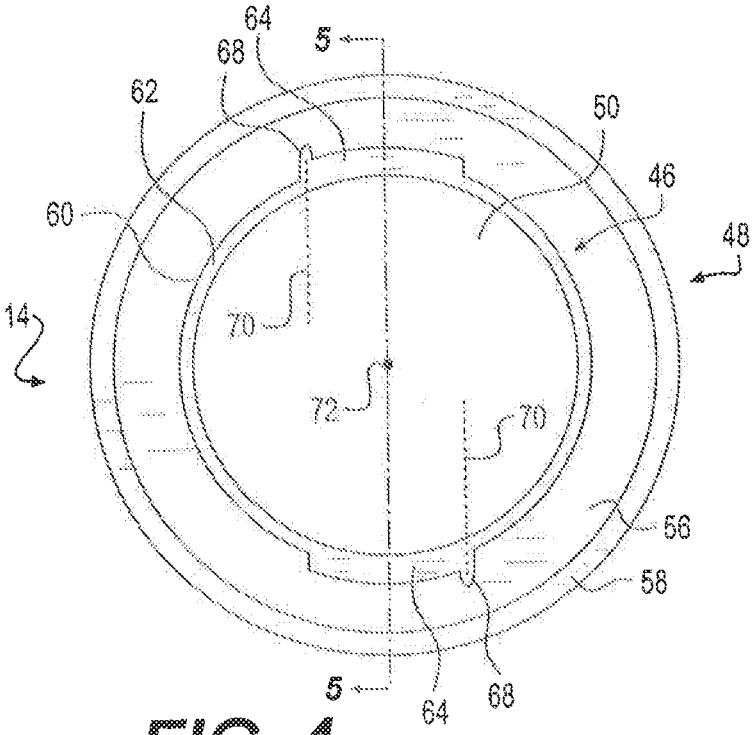
Figure 5:
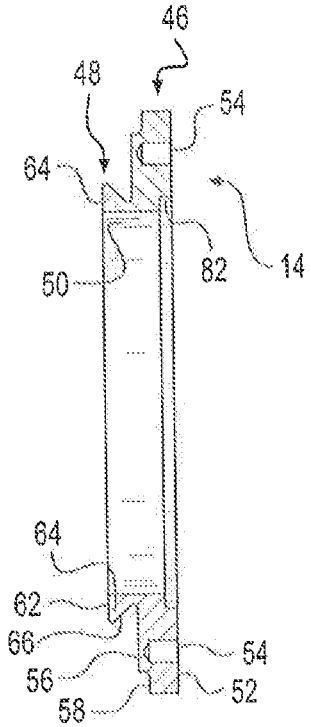

As shown in FIGS. 3-5, mounting flange 14 may include a generally cylindrical upper member 46, a generally cylindrical lower member 48, and a central bore 50 passing through upper and lower members 46, 48. Upper member 46 may be configured to provide a mounting platform for system component 16 (referring to FIG. 1) and generally remain engaged with upper surface 31 of top side 22 (referring to FIG. 2) after assembly. Lower member 48 may be configured to engage lower surface 33 of top side 22, thereby retaining mounting flange 14 connected to tank 12, as will be described in more detail below. Central bore 50 may provide a fluid path for the contents of tank 12 through upper and lower members 46, 48.

Upper member 46 may have an outer diameter greater than the outer diameter of lower member 48 and opening 32 (referring to FIG. 2), and include an axially exterior surface 52 that is generally planar and at least one mounting feature 54 (shown only in FIG. 5) at surface 52 that is configured to retain system component 16 (referring to FIG. 1). In the disclosed embodiment, mounting feature 54 may be a threaded bore configured to receive fasteners of system component 16. It is contemplated, however, that mounting feature 54 may embody another type of mounting feature known in the art, if desired, such as a threaded stud, an interlocking tab, or another feature. Upper member 46 may also include an axially interior surface 56 that is generally planar and configured to engage resilient member 18 at top side 22. In some embodiments, interior surface 56 may include a stepped shoulder 58 at a periphery thereof, if desired. In these embodiments, stepped shoulder 58 may facilitate a grinding/polishing fabrication procedure.

Lower member 48 may extend axially from interior surface 56 and include an annular side surface 60 and an axially exterior surface 62. An outer diameter of annular side surface 60 may be less than an outer diameter of circular center 36 of opening 32 (referring to FIG. 2) such that lower member 48 may pass through opening 32 during assembly. Lower member 48 may also include, at a distal end, at least one arcuate cam segment 64 that extends radially outward from annular side surface 60 (i.e., radially outward from a periphery of lower member 48) at the distal end.

In the disclosed embodiment, lower member 48 includes two substantially identical arcuate cam segments 64 that are located at opposing sides of lower member 48, although any number of arcuate cam segments 64 may be included. Arcuate cam segments 64 may have an outer diameter greater than an outer diameter of annular side surface 60 and circular center 36 (referring to FIG. 2), but less than an outer diameter of arcuate recesses 38 and upper member 46, and an arc angle that is equal to or less than about 90°. The difference in diameters between arcuate cam segments 64 and circular center 36 and arcuate recesses 38 may facilitate passage of lower member 48 into tank 12 via opening 32 and, after rotation of mounting flange 14, the engagement between arcuate cam segments 64 and lower surface 33 of top side 22 that retains mounting flange 14 connected to tank 12.

Arcuate cam segments 64 may have an axially exterior surface that is generally co-planar with exterior surface 62, and an axially interior surface 66 that is inclined relative to an axis of central bore 50. The inclination angle of interior surface 66 may be substantially constant or, alternatively vary (e.g., decrease) along an arc length of segments 64. The inclination angle of interior surface 66, together with the generally planar interior surface of upper member 46, may create a space therebetween that has a greater axial dimension at an outer diameter of lower member 48 than at an inner diameter thereof. The exterior surface of arcuate cam segments 64 may merge with interior surface 66 at an outer diameter of arcuate cam segments 64. As will be described in more detail below, when assembled, interior surface 66 may engage lower surface 33 of top side 22 (referring to FIG. 2). In some embodiments, lower surface 33 may include an internal chamfer (shown in FIG. 6) at the engagement with interior surface 66 that matches the inclination of interior surface 66. The matching angular surfaces may help to improve engagement between the two components.

Lower member 48 may also include at least one rotational stop feature 68 at an arc end of one or both of arcuate cam segments 64. In the disclosed embodiment, one rotational stop feature 68 is integral with each arcuate cam segments 64 and located at a counter-clockwise arc end (when viewed from the lower-member end of mounting flange 14 as shown in FIGS. 3 and 4) of the corresponding cam segment 64. It is contemplated, however, that rotational stop features 68 may be completely separate from arcuate cam segments 64 and located at another angular location around annular side surface 60, if desired.

As shown in FIG. 4, rotational stop features 68 may be radially-oriented protrusions that extend outward from annular surface 60 at the arc end of cam segments 64. Each of rotational stop features 68 may be generally elongated, and have a length direction greater than a width direction and a plane of symmetry (not shown) that is generally orthogonal to exterior surface 62 and extends in the length direction along a dashed line 70. In the disclosed embodiment, the planes of symmetry of rotational stop features 68 may be generally parallel to each other and tangential relative to an axis 72 of central bore 50 (i.e., not passing through axis 72). In addition, rotational stop features 68 may have an axial exterior surface that is generally co-planar with exterior surface 62, and inclined interior surfaces 74 that extend from exterior surface 62 inward toward interior surface 56 of upper member 46 and meet at a lengthwise knife-edge to form a general wedge shaped cross-section. When mounting flange 14 is fully assembled to tank 12, the knife-edges of rotational stop features 68 may be urged into the recesses of rotational stop features 40, thereby inhibiting rotation of mounting flange 14 relative to tank 12.

The geometry of rotational stop features 68 may facilitate reduced complexity and cost associated with manufacturing mounting flange 14. In particular, the angular orientation (i.e., being tangentially oriented) and inclined surfaces (i.e., the wedge shaped cross-section) of rotation stop features 68 may allow for mounting flange 14 to be produced through a simple low-cost casting process that utilizes a multi-piece (e.g., a two-piece) mold.

Figure 6:
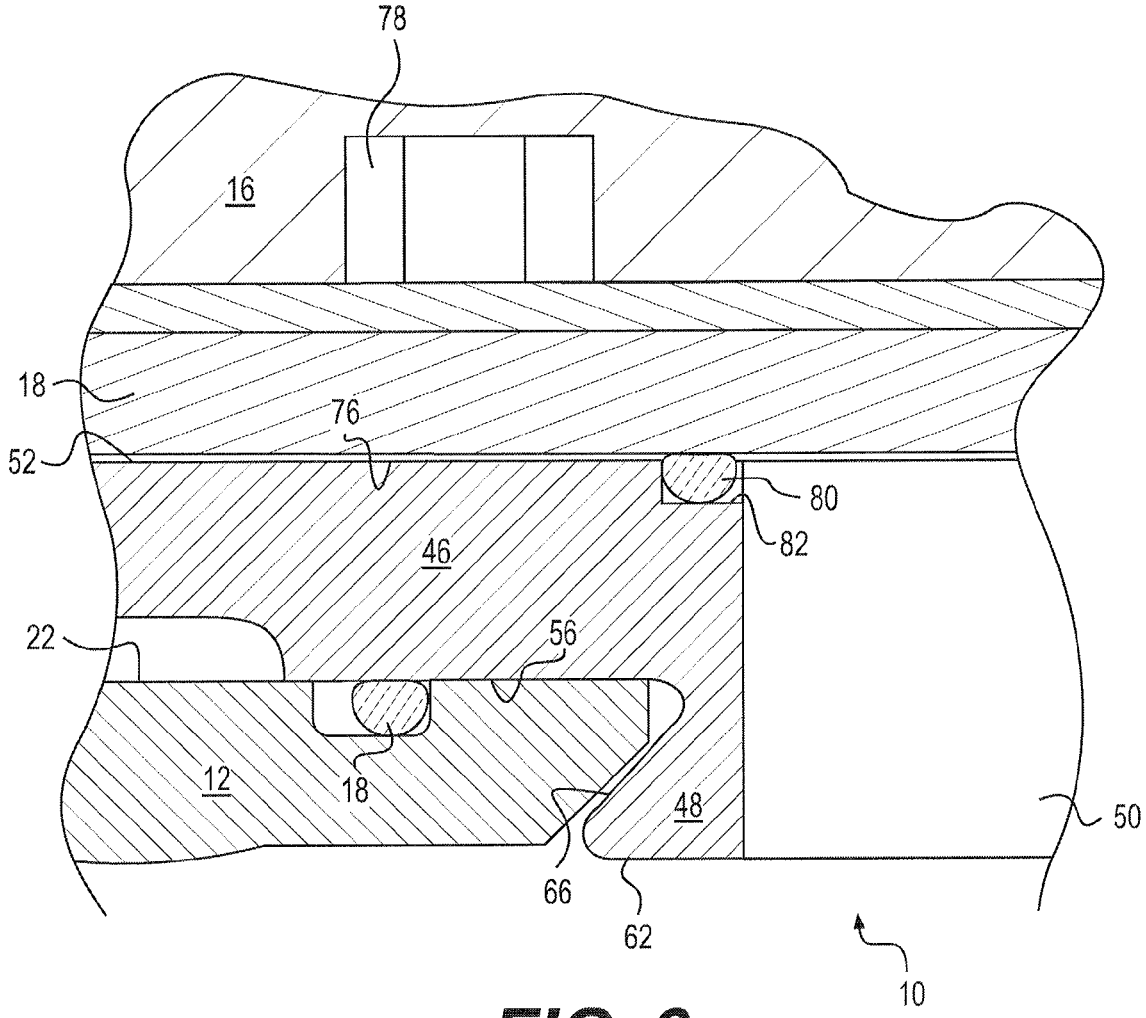
FIG. 6 is an enlarged cross-sectional illustration of a portion of the tank assembly of FIG. 1.

Resilient member 18 may be a compressible gasket, for example a polymeric o-ring, that performs multiple functions for tank assembly 10. First, resilient member 18 may create a substantially fluid-tight seal between tank 12 and mounting flange 14 by deforming when compressed (as shown in FIG. 6) to fill voids that might exist at the interface. Second, resilient member 18, because of its resiliency, may function as a spring when compressed to urge upper member 46 of mounting flange 14 away from tank 12 and rotational stop feature 68 into rotational stop feature 40, thereby inhibiting rotation of mounting member 14 (i.e., inhibiting the rotation of cam segments 64 toward arcuate recesses 38) to a point of disengagement.

System component 16 may be any type of component known in the art that requires or benefits from connection to tank 12. For example, system component 16 may be a filter, a manifold, a pump (shown in FIG. 1), a sensor, a valve, or another similar component or combination of components. As shown in FIG. 6, system component 16 may including a mounting surface 76 configured to engage exterior surface 52 of upper member 46, and one or more mounting features 78 (e.g., threaded fasteners) configured to engage mounting features 54 (referring to FIG. 5) of mounting flange 14. In one embodiment, a seal 80, for example an o-ring, may be positioned between system component 16 and mounting flange 14, if desired. In this embodiment, mounting flange 14 may be provided with geometry 82 (e.g., a shoulder or groove) configured to receive seal 80. Alternatively or additionally, mounting surface 76 of system component 16 may be provided with seal-receiving geometry, if desired.

Industrial Applicability

The disclosed tank assembly may be applicable to any machine fluid system where containment and isolation of a specific fluid is desired. The disclosed tank assembly may be particularly applicable to applications where other system components require direct mounting on the tank assembly. The disclosed tank assembly may provide for direct mounting of system components via a mounting configuration that is simple and inexpensive to fabricate, as well as durable under extreme conditions. Assembly of tank assembly 10 will now be described.

To construct tank assembly 10, resilient member 18 may first be placed within groove 34 at top side 22 of tank 12. Mounting flange 14 must then be oriented so that arcuate cam segments 64 generally align with arcuate recesses 38 in top side 22 of tank 12, and then be passed through opening 32 into tank 12 until interior surface 56 of upper member 46 engages resilient member 18. At this point in time, lower member 48 may be at least partially within the enclosed volume of tank 12. Mounting flange 14 may then be pushed further toward tank 12 and against resilient member 18, until resilient member 18 compresses sufficiently for rotational stop feature 68 to clear lower surface 33 of top side 22. Mounting flange 14 may now be free to rotate relative to tank 12.

Mounting flange 14 may be twisted during assembly until rotational stop features 68 generally align with rotational stop features 40 in tank 12. In the illustrated embodiment, this rotation may be about equal to a ¼ turn (i.e., a 90° turn) in the clockwise direction, although it is contemplated that mounting flange 14 may alternatively be rotated by a different amount and/or in the counter-clockwise direction during assembly, if desired. When rotational stop feature 68 is generally aligned with rotational stop feature 40, resilient member 18 may be allowed to now at least partially decompress and bias the wedge shape of rotational stop features 68 upward into engagement with rotational stop features 40, thereby rotationally locking mounting flange 14 to tank 12. At this point in time, resilient member 18 may still be compressed somewhat to provide a substantially fluid-tight seal between mounting flange 14 and tank 12. Mounting flange 14 may only be disassembled from tank 12 via recompression of resilient member 18 and reverse rotation (e.g., counter-clockwise rotation) of mounting flange 14 relative to tank 12. System component 16 may be connected to mounting flange 14 via seal 80 and fasteners 78 before or after mounting flange 14 is locked to tank 12.

The disclosed tank assembly may be simple and inexpensive. In particular, because no hardware may be required to connect mounting flange 14 to tank 12, the manufacture cost and complexity of both components may be low. In addition, the geometry of the features (arcuate cam segments 64 and rotational stop features 40, 68) that lock mounting flange 14 to tank 12 may be few in number and relatively simple. Further, the design of mounting flange 14 may be generic and allow a variety of different system components to be mounted to tank 12, thereby decreasing a cost of tank assembly 10 while also increasing an applicability of tank assembly 10.

The disclosed tank assembly may also be durable. In particular, after mounting flange 14 is connected to tank 12, disassembly may be inhibited via rotational stop features 40 and 68. That is, mounting flange 14 may only be disassembled from tank 12 by recompression of resilient member 18 and subsequent rotation of mounting flange 14 relative to tank 12. This resistance to disassembly may allow the use of tank assembly 10 in extreme conditions, such as high-vibration conditions where other types of assemblies may be unreliable.

It will be apparent to those skilled in the art that various modifications and variations can be made to the tank assembly of the present disclosure. Other embodiments of the tank assembly will be apparent to those skilled in the art from consideration of the specification and practice disclosed herein. For example, although not shown in the associated figures, it is contemplated that tank assembly 10 may include addition features, if desired, such as a fill spout, a carrying handle, a drain valve, a fluid level sensor, internal baffles, and other similar features. It is intended that the specification and examples be considered as exemplary only, with a true scope of the disclosure being indicated by the following claims and their equivalents.

What is claimed is:

1. A tank assembly, comprising:

a tank enclosing a volume and having a sidewall with an upper surface and a lower surface and defining an opening into the volume and a first rotational stop feature at the opening, wherein the opening into the tank includes a generally circular center and at least one arcuate recess located at a periphery of the generally circular center, and the first rotational stop feature includes at least one recess in the sidewall of the tank;

a mounting flange having an upper member configured to engage the upper surface of the sidewall, a lower member configured to engage the lower surface of the sidewall, and a second rotational stop feature configured to engage the first rotational stop feature, wherein the lower member includes at least one arcuate cam segment extending radially outward, the at least one arcuate cam segment configured to pass through the at least one arcuate recess during assembly, and the second rotational stop feature includes at least one protrusion extending from the lower member of the mounting flange radially outward a greater distance than a radially outermost surface of the at least one arcuate cam segment; and a resilient member disposed between the tank and the mounting flange, the resilient member configured to substantially seal an interface between the tank and the mounting flange and to bias the second rotational stop feature into engagement with the first rotational stop feature upon at least partial decompression of the resilient member when the mounting flange is locked to the tank.

2. The tank assembly of claim 1, wherein:

the first rotational stop feature is located in a clockwise direction spaced from an arc end of the at least one arcuate recess; and the second rotational stop feature is located at an arc end of the at least one arcuate cam segment.

3. The tank assembly of claim 1, wherein an outer diameter of the at least one arcuate cam segment is greater than a diameter of the generally circular center of the opening into the tank and less than an outer diameter of the at least one arcuate recess.

4. The tank assembly of claim 1, wherein the at least one protrusion extends radially outward a greater distance than a remaining portion of the lower member, and includes a generally planar exterior surface and a wedge-shaped interior surface configured to engage the at least one recess of the first rotational stop feature.

5. The tank assembly of claim 1, wherein:

the at least one recess includes two recesses located at opposing sides of the opening; and the at least one protrusion includes two protrusions located at opposing sides of the lower member.

6. The tank of claim 5, wherein:

each of the two protrusions has a center plane of symmetry that is generally parallel with the center plane of symmetry of the other of the two protrusions; and each center plane of symmetry is radially offset from an axis of the lower member.

7. The tank assembly of claim 1, wherein:

one of the upper member and the upper surface of the sidewall of the tank includes a generally planar axial sealing surface; and the other of the upper member and the upper surface includes an annular groove configured to receive the resilient member.

8. The tank assembly of claim 1, wherein:

the upper member includes an axially exterior surface and an axially interior surface located opposite the axially exterior surface; and the mounting flange further includes at least one mounting feature at the axially exterior surface that is configured to provide mounting for a fluid system component.

9. The tank assembly of claim 8, wherein the mounting flange further includes a central bore passing through the upper and lower members.

* * * * *